United States Patent [19]

Savicki, Sr.

[11] Patent Number: 5,030,156

[45] Date of Patent: Jul. 9, 1991

[54] ELECTRONIC REMOTE CONTROL AND METHOD FOR CONTROL-LINE AIRPLANE MODELS

[76] Inventor: Paul D. Savicki, Sr., Rte 1, Box 885, Linwood, N.C. 27299

[21] Appl. No.: 483,393

[22] Filed: Feb. 22, 1990

[51] Int. Cl.[5] ..... A63H 27/04; A63H 27/00; A63H 18/00; A63H 13/20

[52] U.S. Cl. ..... 446/32; 446/456; 446/34; 272/31 A; 272/285

[58] Field of Search ..... 446/30, 31, 32, 33, 446/34, 254, 256, 454, 456; 272/31 R, 31 A, 285

[56] References Cited

U.S. PATENT DOCUMENTS

| | | | |
|---|---|---|---|
| 2,390,307 | 12/1945 | Kelecius | 446/32 X |
| 2,409,168 | 10/1946 | Walker | 446/30 X |
| 2,530,725 | 11/1950 | Pizer | 446/456 X |
| 2,885,206 | 5/1959 | Ensley | 446/31 X |
| 2,913,244 | 11/1959 | Cottle, Jr. | 446/31 X |
| 3,058,260 | 10/1962 | Sanborn | 446/31 |
| 3,107,452 | 10/1963 | Berger | 446/30 |
| 4,387,532 | 6/1983 | Suimon | 446/456 X |
| 4,568,306 | 2/1986 | Martin | 446/456 X |

*Primary Examiner*—Robert A. Hafer
*Assistant Examiner*—D. Neal Muir

[57] ABSTRACT

A control apparatus for model airplanes is presented which includes a remote radio transmitter which communicates with a rotatably mounted receiver positioned on a fixed pylon. The receiver has a control handle joined thereto whereby control lines are actuated for controlling the upward and downward movement of the elevators of the model airplane as the plane encircles the pylon.

24 Claims, 4 Drawing Sheets

18
20
31
27
30
28
10
21
32
26
22
19
23
25
15
14
16
11

ELECTRONIC REMOTE CONTROL AND METHOD FOR CONTROL-LINE AIRPLANE MODELS

BACKGROUND OF THE INVENTION

1. Field Of The Invention

The present invention pertains to model airplane control devices and particularly to model airplanes which are powered by internal combustion engines and orbit a central pylon by the utilization of control lines attached to the model plane.

2. Description Of The Prior Art And Objectives Of The Invention

For many years model airplane enthusiasts have flown "free flight" planes having radio receivers which activate controls within the airplanes. A hand held transmitter is used by the operator to control the flight of the model airplane by sending radio signals to the receiver. Such remote control systems have one or more channels for controlling the rudder, elevators, ailerons, internal combustion engine speed or for other functions. Other model enthusiasts prefer a manually controlled airplane also powered by an internal combustion engine in which a handle is held by the operator having one or more guide lines which tether the airplane, whereupon it flies in a circle around the operator and can be maneuvered by the motion of the handle. Various other types of model airplanes have been flown in the past which are tethered to a central pylon and can be controlled remotely by mechanical or electrical mechanisms which are positioned outside of the circular flight path of the airplane.

It is not unusual for remote radio controlled model airplanes to be lost in flight, and this can cause property or personal injury much to the chagrin of the operators. Such losses may be due to electrical or mechanical malfunctions of the airplane controls, pilot error, weather conditions or the like. In addition, manually controlled tethered airplanes are crashed occasionally due to inexperience of the operators, dizziness, wind conditions and for other causes. Tethered model airplanes which are mechanically or electrically, remotely controlled oftentimes limit the operator's mobility and enjoyment during flying. Hence, a need has existed for a more realistic and convenient model airplane control system which utilizes the operator freedom of conventional radio controlled model aircraft but includes the convenience and safety of manual or mechanically remote tethered control systems.

Thus, the present invention was conceived with an awareness of the aforesaid problems and disadvantages of conventional model airplane flying controls and it is an objective of the present invention to provide model airplane control apparatus which includes a hand held radio transmitter which allows virtually unlimited movement of the operator or pilot as he controls a tethered aircraft.

It is also an objective of the present invention to provide control apparatus for a tethered model airplane which includes a fixed pylon to which a rotatable radio receiver is affixed.

It is still another objective of the present invention to provide control apparatus for a model airplane whereby the radio receiver is connected to control lines of a model airplane for maneuvering purposes which allows the airplane to encircle the receiver as it rotates.

It is still another objective of the present invention to provide a model airplane control system which is relatively inexpensive to purchase, easy to assemble and in which the control maneuvers can be quickly learned by inexperienced enthusiasts.

Various other details and advantages of the invention herein will be understood by those skilled in the art as a more revealing presentation is set forth below.

SUMMARY OF THE INVENTION

The aforesaid and other objectives are realized by providing control apparatus for a model airplane which includes a remote radio transmitter for generating a signal which is accepted by a receiver positioned on a pylon some number of yards therefrom. The receiver includes means to operate the controls of an internal combustion engine powered model airplane which is attached by one or more wires to the receiver. The model airplane will thus fly in a circular pattern around the pylon and the operator can control the upward and downward movement of the plane by the switches, buttons and levers located on the transmitter. The transmitter may be of the conventional single channel type since the tethered aircraft needs only to be manipulated either upwardly or downwardly since it flies at the full extent of the control line which may be for example, forty feet in length measured from the central pylon. The operator of the transmitter can freely move around the circle to a more desirable viewing location as often as needed and can teach other enthusiasts the art of flying a model airplane without concern of the sweeping control lines as during conventional manual control line flying. The receiver, by being pivotally mounted on the pylon rotates with the circling aircraft and operating means attached to the receiver transmits signals mechanically to the aircraft through the control lines during flight maneuvers.

DESCRIPTION OF THE PREFERRED EMBODIMENT

Figure 5:
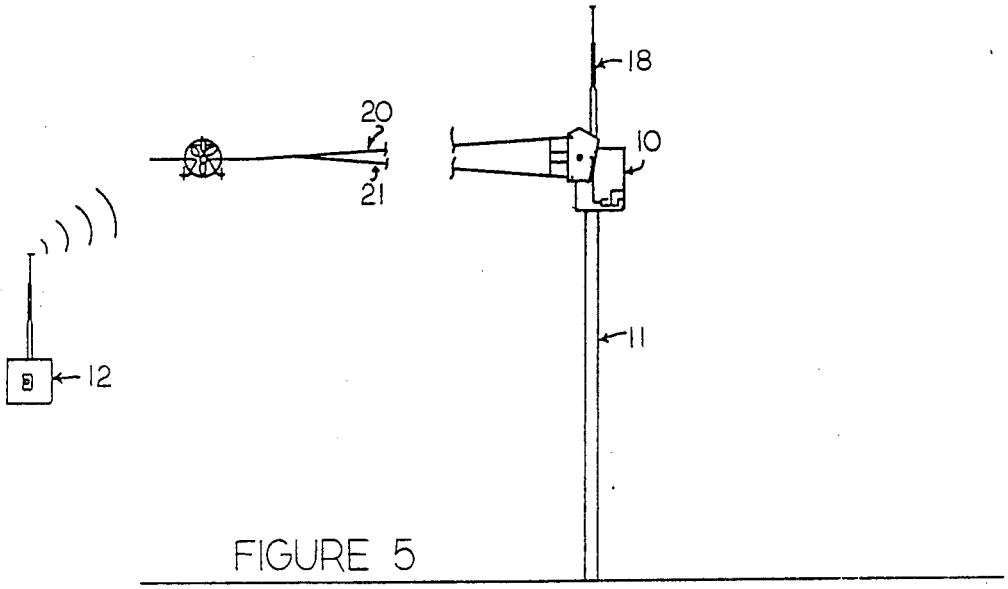
FIG. 5 pictures a front elevational view of a tethered model airplane in a substantially level flight.

The preferred form of the control apparatus of the invention is shown in FIG. 5 in which a conventional hand held radio signal transmitter generates a signal to a receiver which is rotatably mounted on a pylon. Means to operate the control lines of the model airplane are affixed to the receiver along with a control line guide for better flight control and maneuverability. The radio transmitter shown is of the single channel type since, as for example, only the elevators of the airplane need to move to control the upward and downward motion of the plane as it.encircles the pylon. By controlling the airplane with the hand held transmitter, the "pilot" can move to any of a number of selected positions outside the flight circle without having to be concerned with the sweeping control lines as are of great concern during conventional, manual control line plane flying.

The preferred means to operate the airplane elevators consists of a conventional radio receiver which accepts the transmitted radio signal and directs an electric motor to turn or move an actuator which is joined to the control handle. The control handle, by pivotal movement caused by the actuator, pushes and simultaneously pulls a pair of spaced, thin metal control wires which are attached to a conventional bell crank system within the plane to operate the elevators of the model plane and thus control its flight pattern.

DETAILED DESCRIPTION OF THE DRAWINGS AND OPERATION OF THE INVENTION

Figure 1:
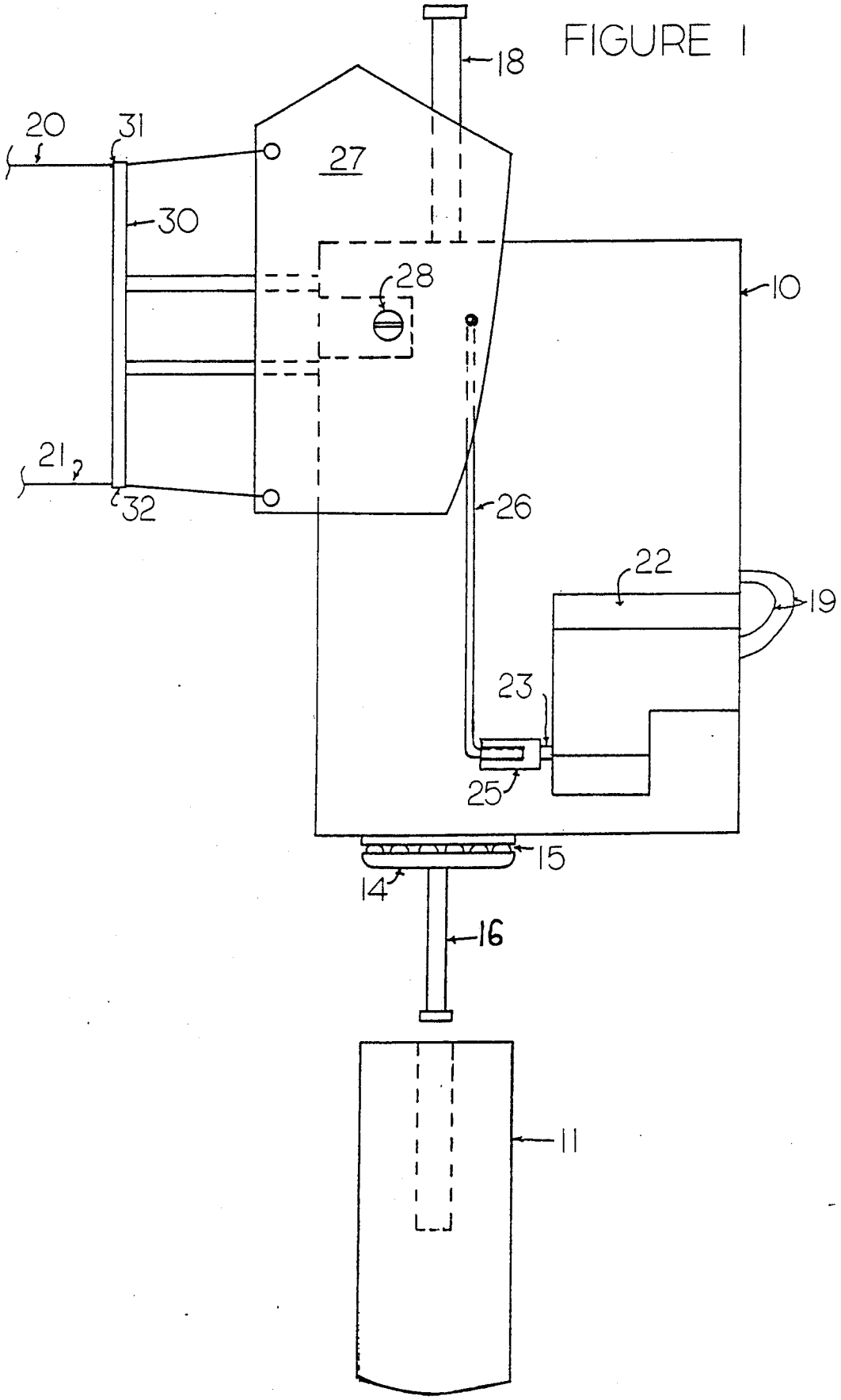
FIG. 1 demonstrates a side elevational view of a radio receiver of the invention.
Figure 7:
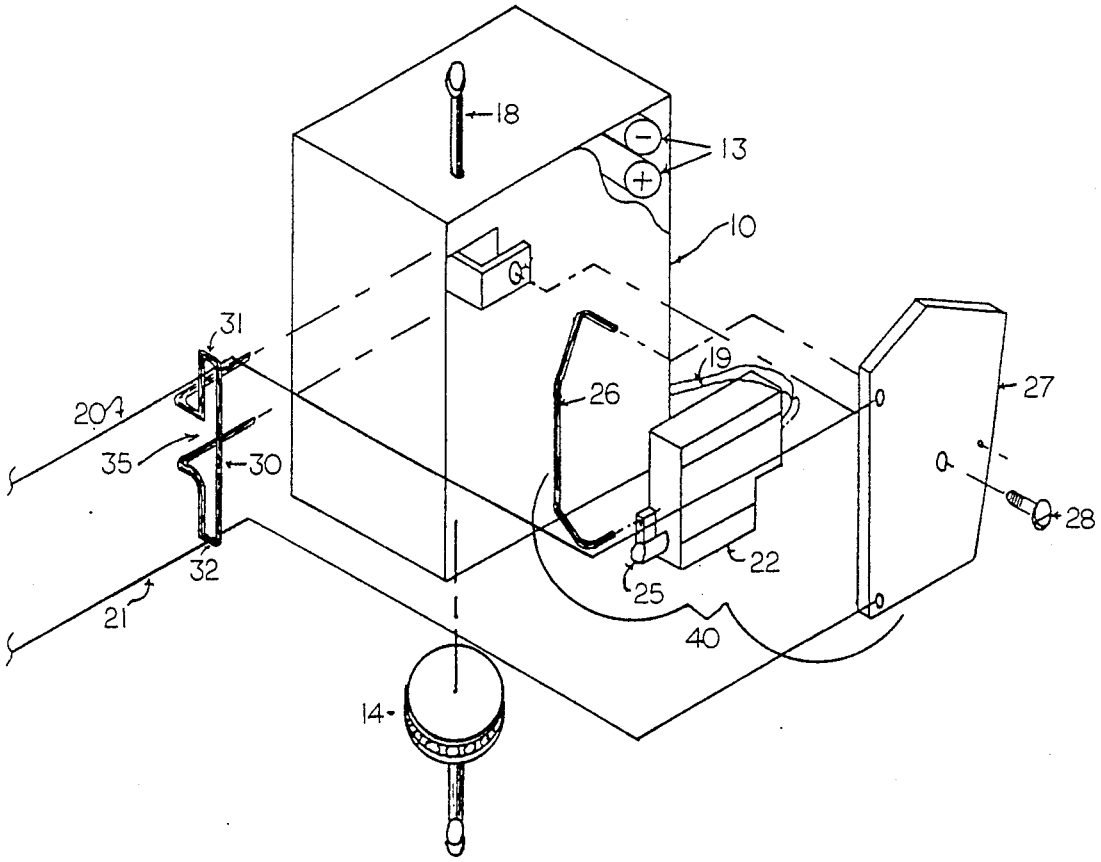
FIG. 7 shows the radio receiver and attached components of FIG. 1 in substantially exploded fashion for clarity.

Turning now to the drawings, FIG. 1 illustrates radio receiver 10 removed from pylon 11 as seen in FIG. 5. Receiver 10 is a conventional one channel model plane radio receiver although more than one channel could be employed if desired. Said receiver 10 includes batteries 13 as shown in FIG. 7 and has been modified by the addition of a means 14 for rotatably joining receiver 10 to pylon 11 which may consist of a wooden post or a steel, aluminum or plastic pipe secured in the ground. Means 14 comprises an encasement 15 for ball bearings, and a bearing post 16. Means 14 is placed into pylon 11 by post 16 and is attached to receiver 10 by bolts or by some other suitable method. Receiver antenna 18 is positioned atop receiver 10 as shown in FIG. 1 and accepts the radio signals generated by conventional transmitter 12 (seen in FIG. 5).

Figure 3:
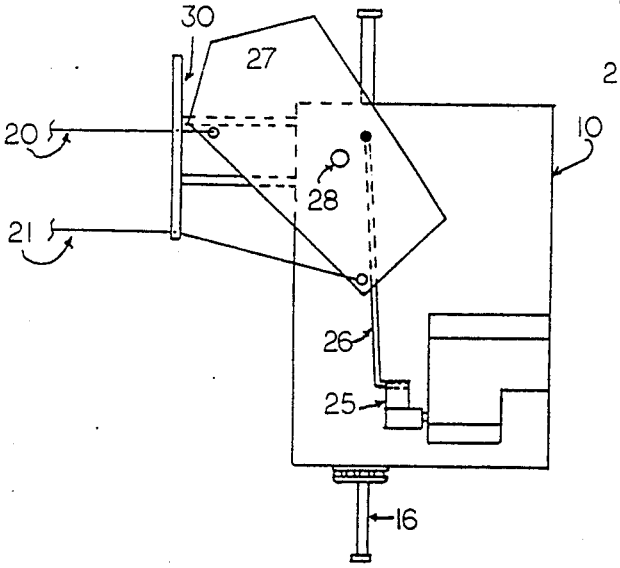
FIG. 3 depicts a partial side elevational view of the receiver with the plane flying below the top of the pylon.
Figure 4:
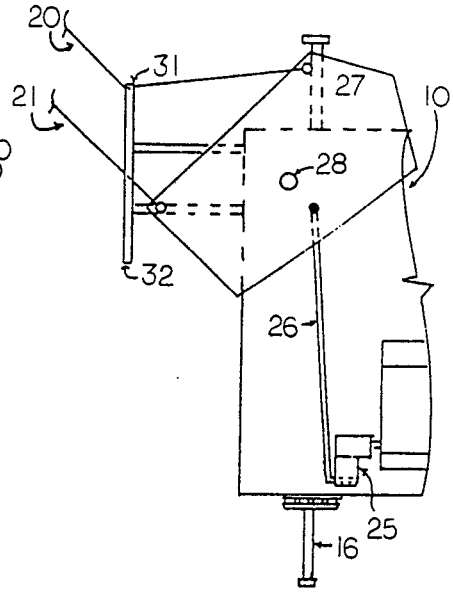
FIG. 4 illustrates the transmitter of FIG. 3 with the plane flying above the top of the pylon and receiver.

A means 40 is provided on the outside of receiver 10 as illustrated in FIG. 7 to operate or manipulate top control line 20 and bottom control line 21 (FIGS. 1 and 5). Receiver 10 is electrically connected by wires 19 to electric motor 22. As electric motor 22 is reversible, motor shaft 23 will turn either clockwise or counterclockwise depending on the signal sent by transmitter 12. If the pilot desires to elevate the flight of plane 24 as pictured in FIG. 5, a lever controller (not shown) on transmitter 12 is pushed causing electric motor 22 to rotate motor shaft 23 in a clockwise direction, as viewed from the shaft side of motor 22 in FIG. 1, whereby actuator 25 moves downward as viewed in FIG. 1, causing actuator control rod 26 to also move downwardly thereby pivoting control line handle 27 mounted on handle axle 28 to a position as generally shown in FIG. 4. Control line 20 is "pulled" by the pivoting action of handle 27 which in turn will cause the elevators (not shown) of model plane 24 to raise, which will in turn cause the airplane to climb depending on the degree and time of elevator movement. If it is desired to decrease the elevation of plane 24 from its horizontal circular flight path, the appropriate lever is moved on transmitter 12 which in turn will cause counterclockwise rotation of motor shaft 23 thus pushing actuator control rod 26 upwardly and causing control line handle 27 to pivot as shown in FIG. 3. The elevational flight of model airplane 24 is thereby decreased. As would be understood, the degree and length of time of rotation of handle 27 and the related plane elevator movement is dependent on numerous structural factors and a smooth, level flight or change of flight elevation is a function of the experience of the pilot, wind conditions, particular speed and physical limitations of the plane. A dual control line system is discussed, supra, however a single or other multiple control line system could be employed if desired formed from metal, nylon or other suitable materials.

Figure 2:
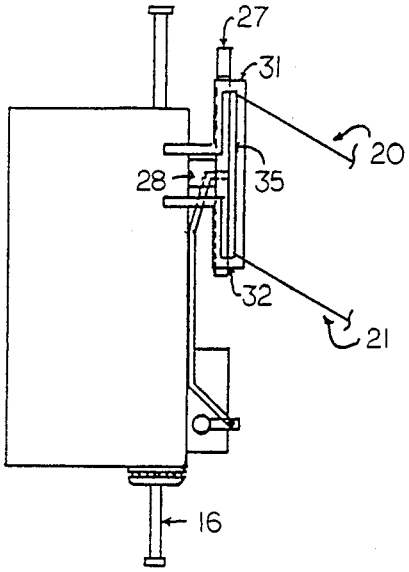
FIG. 2 shows a front view of the receiver as shown in FIG. 1.

As additionally seen in FIGS. 3 and 4, bracket 30 is seen connected to receiver 10. Bracket 30 acts as a control line guide for plane 24 when flying in other than a level, horizontal flight path at the height of receiver 10, substantially as shown in FIG. 5. Bracket or guide 30 will prevent undue stress to handle 27 from lines 20, 21 during flight since lines 20 and 21 will remain separated between bracket 30 and handle 27, and at an appropriate angle to handle 27 and will not become acutely disposed thereto even when plane 24 is flying vertically over pylon 11 or at ground level as demonstrated by the control line positions of FIG. 3 and 4. Bracket 30 includes transverse bracket members 31, 32 which partially define opening 35 as shown in FIG. 2. Members 31, 32 contact respectively lines 20, 21 at extreme flight lows or highs as mentioned above regarding FIGS. 3 and 4.

Figure 6:
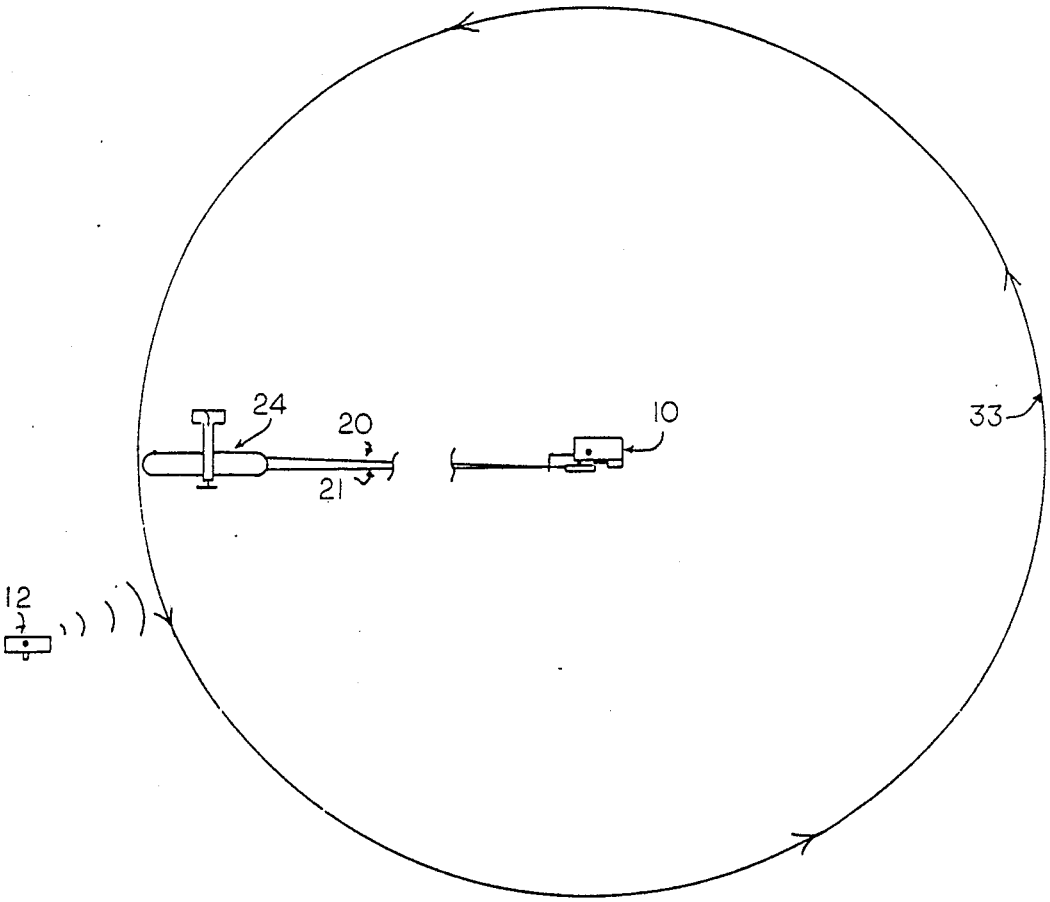
FIG. 6 demonstrates the flight pattern of the aircraft of FIG. 5 in a top plan view.

As would be understood, model airplane 24 travels in a circular path 33 around pylon 11 as demonstrated in FIG. 6 with control lines 20, 21 being substantially fully extended at all times. Various maneuvers or stunts can be undertaken such as looping plane 24, performing wingovers whereby plane 24 flies vertically over pylon 11, upside down flying and other stunts as within the skill and experience of the pilot operator. A student can thus be easily taught to fly model plane 24 by one of greater experience since radio transmitter 12 is held outside of flight path 33, as illustrated in FIG. 6 without the fear of contact with metal control lines 20, 21 as they encircle or sweep around pylon 11.

The illustrations and examples provided herein are for explanatory purposes and are not intended to limit the scope of the appended claims.

I claim:

1. Apparatus to control the circular flight path of a tethered model airplane comprising: a transmitter, a receiver, said transmitter in radio communication with said receiver, a model airplane, a control line, said line joined to said airplane and to said receiver, said airplane in remote spatial relation to said receiver whereby signals generated by said transmitter are accepted by said receiver for controlling the flight of said airplane by the manipulation of said control line.

2. Control apparatus for a model airplane as claimed in claim 1 wherein said transmitter comprises a radio signal transmitter.

3. Control apparatus for a model airplane as claimed in claim 1 and including a pylon, said receiver attached to said pylon.

4. Control apparatus for a model airplane as claimed in claim 3 wherein said receiver is rotatably attached to said pylon.

5. Control apparatus for a model airplane as claimed in claim 1 and including a means for operating said control line, said operating means affixed to said receiver.

6. Control apparatus for a model airplane as claimed in claim 5 wherein said operating means is pivotally mounted on said receiver.

7. Control apparatus for a model airplane as claimed in claim 1 wherein said control line comprises a pair of metal wires.

8. Control apparatus for a model airplane as claimed in claim 1 wherein said transmitter comprises a single channel transmitter.

9. Control apparatus for a model airplane as claimed in claim 5 wherein said operating means comprises: an electric motor, a control line handle, an actuator, said actuator connected to said motor and to said control line handle.

10. Control apparatus for a model airplane as claimed in claim 1 and including a line guide, said line guide affixed to said receiver.

11. Apparatus to control the circular flight path of a tethered model airplane comprising: a radio transmitter, a radio receiver, said receiver for accepting signals from said transmitter, a pylon, said receiver affixed to said pylon, a maneuverable model airplane, a pair of control lines, said lines joined to said model airplane for maneuvering said plane, means for operating said control lines, said operating means joined to said receiver, said model airplane for flying in spatial relation to said receiver, said control lines attached one above the other to said operating means whereby signals generated by said transmitter will cause operation of said control lines to maneuver said model airplane.

12. Control apparatus for a model airplane as claimed in claim 11 and including a line guide, said line guide joined to said transmitter proximate said control lines, said line guide defining a vertical longitudinal opening for receiving both of said control lines therein.

13. Control apparatus for a model airplane as claimed in claim 11 wherein said receiver is rotatably affixed to said pylon.

14. Control apparatus for a model airplane as claimed in claim 11 wherein said transmitter is a single channel transmitter.

15. Control apparatus for a model airplane as claimed in claim 11 wherein said operating means comprises an electric motor.

16. Control apparatus for a model airplane as claimed in claim 11 and including a battery, said battery connected to said receiver.

17. Control apparatus for a model airplane as claimed in claim 11 wherein said operating means comprises a control line handle, said control line handle pivotally connected to said receiver.

18. Control apparatus for a model airplane as claimed in claim 11 and including means for rotating said receiver, said rotating means affixed to said receiver and to said pylon.

19. Control apparatus for a model airplane as claimed in claim 17 wherein said operating means comprises an actuator, said actuator joined to said control line handle.

20. Control apparatus for a model airplane as claimed in claim 12 wherein said line guide comprises a bracket.

21. A method of controlling the flight of a tethered model airplane comprising the steps of:

(a) affixing a radio receiver to a means to operate the tether, (b) rotatably affixing said radio receiver to a pylon, (c) flying said model airplane around said pylon, and (d) controlling the flight of said model airplane with a radio transmitter in communication with said receiver.

22. The method of claim 21 wherein the step of affixing a radio receiver comprises the step of affixing a radio receiver to a pivotable tether operating means.

23. The method of claim 21 wherein the step of rotatably affixing said radio receiver comprises the step of affixing said radio receiver by a bearing encasement to said pylon.

24. The method of claim 21 wherein the step of controlling the tethered flight comprises controlling the flight of said model airplane by a radio transmitter outside of the tethered path of said airplane.

* * * * *